United States Patent [19]

Schmidt

[11] Patent Number: 4,702,633

[45] Date of Patent: Oct. 27, 1987

[54] MULTICOLOR WRITING IMPLEMENT

[75] Inventor: Günther Schmidt, Baden-Baden, Fed. Rep. of Germany

[73] Assignee: The Parker Pen Company, Janesville, Wis.

[21] Appl. No.: 190,024

[22] Filed: Sep. 23, 1980

[30] Foreign Application Priority Data

Sep. 24, 1979 [DE] Fed. Rep. of Germany ..... 2938716

[51] Int. Cl.[4] ..... B43K 27/12

[52] U.S. Cl. ..... 401/34; 401/35; 401/213

[58] Field of Search ..... 401/17, 18, 19, 20, 401/34, 35, 213

[56] References Cited

U.S. PATENT DOCUMENTS 1,277,064 8/1918 Gugel ..... 401/35

FOREIGN PATENT DOCUMENTS 650323 7/1961 Canada ..... 401/34
2125452 12/1972 Fed. Rep. of Germany ..... 401/34
620659 5/1961 Italy ..... 401/35

*Primary Examiner*—Steven A. Bratlie
*Attorney, Agent, or Firm*—Edmond T. Patnaude

[57] ABSTRACT

A multicolor writing instrument consists of two individual writing implements which respectively contain a ball point pen refill. The implements are identical in construction with each having an elongated grip portion and a shoulder extending laterally from the end opposite a writing stylus, the shoulders being provided with recesses for respectively and sealably receiving the writing stylus of the other implement when the two implements are connected together in a storage condition.

4 Claims, 6 Drawing Figures

MULTICOLOR WRITING IMPLEMENT

Figure 1:
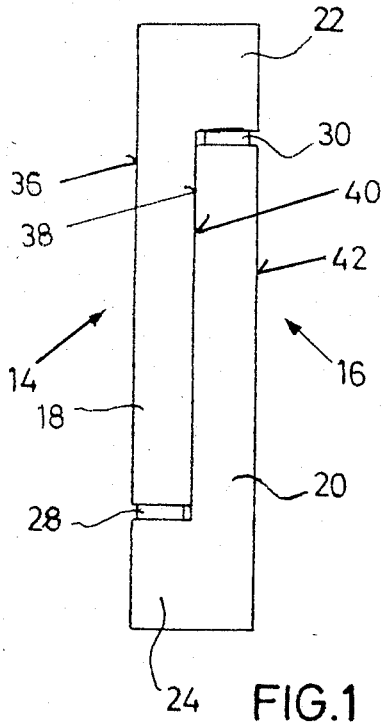

The invention relates to a multicolor writing implement with at least two differently colored, elongated writing devices provided with the particular writing tip or nib which, as desired, can be brought into a writing position which exposes the nib and into an inoperative position in which the nib is covered within a protective sleeve.

In the known multicolor writing implements of this type the various writing devices, generally in the form of ballpoint pen refills, are housed within a single casing, whose external configuration corresponds to that of a conventional fountain pen or a conventional ballpoint pen and by means of a relatively complicated mechanism can be brought into the operative position or back into the inoperative position in the casing. In the said known multicolor writing implements the number of individual writing devices with a specific color is predetermined, namely by the writing devices within the casing, such as ballpoint pen refills and the like. Apart from the problem that such known multicolor writing implements require a relatively complicated mechanism for operating the differently colored individual writing devices, there is also the problem that, e.g., in the case of a four color writing implement the casing must be made relatively thick, which impairs the comfort and ease with which the implement can be used. However, if individual writing implements in a particular color in each case are used to obviate these disadvantages a new disadvantage is encountered that said individual writing implements are relatively cumbersome and bulky and not easy to handle both during transportation and when placed on a desk.

The problem of the invention is to provide a multicolor writing implement in which, when not in use, the individual writing devices constitute an easily transportable unit, whereby the nibs are reliably protected against dirt, drying out, etc., but the possibility still exists of forming writing implements with two, four or even more different colors in the most simple way from corresponding individual writing devices.

According to the invention this problem is solved by a further development of the multicolor writing implement according to the present invention which is, each writing device is part of an individual writing implement and the individual writing implements are assemblable and that each writing device is rigidly constructed from en elongated grip and projects from the particular individual writing implement, whose end remote from the writing device fixed thereto is provided with a laterally projecting shoulder having a recess serving as a protective sleeve for the writing device of an adjacent individual writing implement, whose direction is the opposite to that of the aforementioned writing implement.

Due to its construction the multicolor writing implement according to the invention provides the possibility of assembling such an implement from two, four or more individual writing implements and in which, when not in use, an easily transportable unit is formed. The individual writing devices or nibs are housed in the recesses of the shoulders of adjacent individual writing implements, so that a reliable protection of the different nibs is ensured. However, the individual writing implements can also be assembled in such a way that a flat arrangement is obtained, e.g., enabling easy placing on a desk or the like. It is a characteristic of the multicolor writing implement according to the invention that the shoulder of a "thickened" end of a particular individual writing implement remote from the nib of an adjacent individual writing implement by means of its recess simultaneously serves as a cap for the nib of the adjacent individual writing implement. The color of the ballpoint pen refill or the like of the particular individual writing implement is appropriately indicated in that the individual writing devices following the particular grip from which they project have a portion with a smaller diameter than the grip and following this a stop shoulder for the shoulder of the adjacent grip. The portion with the smaller diameter of the particular writing device has the color of the writing medium of the particular writing device, as is the subject of a preferred embodiment of the invention.

Hereinafter embodiments of the invention are described relative to the diagrammatic drawings, wherein show:

FIG. 1 A first embodiment of the multicolor writing implement according to the invention in the assembled state.

Figure 2:
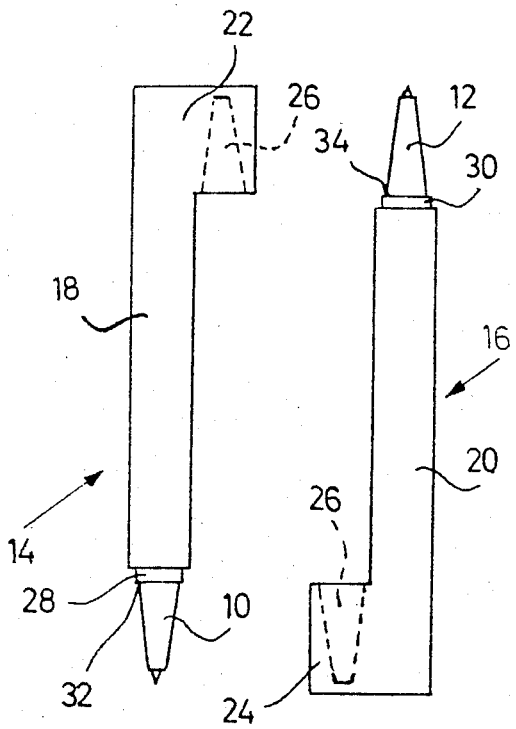

FIG. 2 The individual writing implements of the embodiment of FIG. 1 in the disassembled state.

Figure 3:
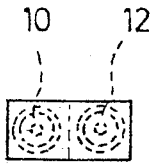

FIG. 3 The embodiment of FIGS. 1 and 2 in the assembled state in plan view.

Figure 4:
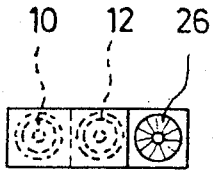

FIG. 4 The embodiment of FIGS. 1 to 3 in "opened out" state.

Figure 5:
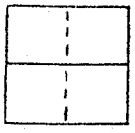

FIG. 5 Another embodiment of the multicolor writing implement according to the invention in plan view.

Figure 6:
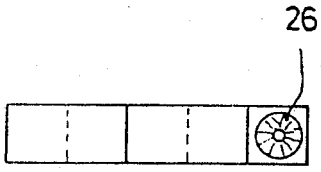

FIG. 6 The embodiment of FIG. 5 in the "opened out" state.

As is apparent from FIGS. 1 and 2 the multicolor writing implement comprises two assemblable individual writing implements 14, 16, having in each case a stylus 10, 12, and a nib. Each stylus 10, 12 rigidly projects from an elongated grip 18, 20, of the particular individual writing implement 14, 16. The end of each individual writing implement 14, 16 remote from the stylus 10, 12 fixed thereto is provided with a laterally projecting shoulder 22, 24 having a recess 26 serving as a protective sleeve for the nib or stylus of an adjacent individual writing implement 16 whose direction is the opposite of that of the individual writing implement 14 in question. The particular stylus 10, 12 can be snap fitted into the recess 26 of shoulder 24, 22 of the adjacent individual writing implement 16, 14. The stylus 10, 12 can in turn be inserted into the associated recess 26 of the adjacent individual writing implement 16, 14, in at least two opposite positions. Thus, it is possible to give the multicolor writing implement the "compact form" shown in FIG. 1 in which the implement can be transported in the pocket, etc., and also the "opened out" from according to FIG. 4 in which the writing implement can easily be placed on a desk or the like. In the embodiment of FIGS. 1 to 3 in which the multicolor writing implement only comprises two individual writing implements 14, 16 this "flat" position is obviously not as important as in the embodiment of FIGS. 5 and 6 in which the multicolor writing implement comprises four individual implements, as can be seen from the drawing. The compact position shown in FIG. 5 can be realized in the same way as the flat position shown in FIG. 6.

The individual styli or writing devices 10, 12 can naturally be ballpoint pen refills as in the represented embodiment, but can also be felt tip pen refills or leads.

The individual styli 10, 12 have, following on to the grip 18, 20 from which they project, a portion 28, 30 having a smaller diameter than grip 18, 20 and following this a stop shoulder 32, 34 for shoulder 24, 22 of the adjacent grip 20, 18. Due to the fact that the smaller diameter portion 28, 30 of the particular stylus 10, 12 indicates the color of the writing medium of the particlar stylus, it is easily possible to establish when the multicolor writing implement is assembled what is the color of the writing medium in the individual writing implement 14, 16. Thus function can also be fulfilled through the complete stylus 10, 12 projecting from the grip 18, 20 having the colors of the writing medium of the particular stylus or writing device.

In the embodiment shown grips 18, 20 and shoulders 22, 24 of the different individual writing implements 14, 16 have complimentary circumferential surfaces 36, 38, 40, 42 ensuring a smooth, tight engagement of the assembled individual writing implements. Thus, in the embodiment shown the grips 18 and 20 are square. In the area of shoulders 22, 24 the individual writing implements 14, 16 have a rectangular cross section comprising both the particular shoulder and the particular grip base. It is finally pointed out that styli 10, 12 are received with sealing fit in the recesses 26, which reliably protects the nibs against dirt and drying out.

The features of the invention disclosed in the description, drawings and claims can be used individually and in random combinations for realizing the various embodiments of the invention.

What is claimed is:

1. A writing implement, comprising in combination first and second grip members each having an elongated gripping portion and a laterally extending shroud portion at one end of said gripping portion, first and second shoulders respectively provided on said laterally extending shroud portions, said shoulders facing toward the other end of the associated gripping portion, a first stylus extending from said other end of said gripping portion of said first grip member, a second stylus extending from said other end of said second grip member, a first stylus receiving recess in said laterally extending portion of said first grip member for removably receiving said second stylus, and a second stylus receiving recess in said laterally extending portion of said second grip member for removably receiving said first stylus when said second stylus is received in said first stylus receiving recess, whereby said first and second grip members may be interconnected with the respective styli extending into the recesses in the other one of said grip members.

2. A writing implement according to claim 1, wherein said first and second grip members are mutually identical.

3. A writing implement according to claim 2, wherein said elongated gripping portions of said grip members are rectangular in cross-section, and said stylus receiving recesses are located so that said elongated gripping portions of said grip members are in mutual abutment when said respective styli extend into the recesses in the other ones of said grip members.

4. A writing implement according to claim 1 wherein said first stylus and said second stylus have external shapes which are respectively complementary to said first and second stylus receiving recesses.

* * * * *